US005816159A

United States Patent [19]

Chrigui

[11] Patent Number: 5,816,159

[45] Date of Patent: Oct. 6, 1998

[54] LIQUID TRANSFER DEVICE FOR ROTARY PRESSES

[75] Inventor: Jilani Chrigui, Creil, France

[73] Assignees: Heidelberger Druckmaschinen AG, Heidelberg, Germany; Heidelberg Harris, S.A., Montataire Cedex, France

[21] Appl. No.: 726,814

[22] Filed: Oct. 7, 1996

[30] Foreign Application Priority Data

Oct. 5, 1995 [FR] France ..... 95 11710

[51] Int. Cl.[6] ..... B41F 31/06; B41F 31/14

[52] U.S. Cl. ..... 101/350.1; 101/352.09; 101/DIG. 32

[58] Field of Search ..... 101/350.1, 350.3, 101/350.4, 351.3, 363, 148, 350.2, 352.01, 352.04, 352.09, DIG. 32

[56] References Cited

U.S. PATENT DOCUMENTS 1,376,983 5/1921 Walser .
1,717,737 6/1929 Schlesinger .
2,120,978 6/1938 Huck ..... 101/350.3
2,822,753 2/1958 Woessner .
2,863,389 1/1958 Faeber .
5,123,351 6/1992 Guaraldi et al. .
5,178,066 1/1993 Guaraldi et al. .

FOREIGN PATENT DOCUMENTS 2 700 297 7/1994 France .
458 327 4/1928 Germany .

*Primary Examiner*—J. Reed Fisher
*Attorney, Agent, or Firm*—Herbert L. Lerner; Laurence A. Greenberg

[57] ABSTRACT

A liquid transfer device for rotary presses includes at least two cylinders which can transfer the liquid, especially ink, and at least one liquid transfer element intended to interact with the two cylinders in order to transfer the ink from one cylinder to the other cylinder. Each liquid transfer element can be displaced in an essentially circular path and come into essentially tangential contact with the cylinders.

9 Claims, 2 Drawing Sheets

LIQUID TRANSFER DEVICE FOR ROTARY PRESSES

BACKGROUND OF THE INVENTION

FIELD OF THE INVENTION

The present invention relates to a liquid transfer device for rotary presses, including at least one ink fountain roller and an inking cylinder which are able to transfer the liquid, especially ink, and at least one liquid transfer element intended to interact with the ink fountain roller and the inking cylinder in order to transfer the ink from the ink fountain roller to the inking cylinder.

Such liquid transfer devices "rocking" back and forth between the two cylinders are used to pick up a liquid from one cylinder or roller of the rotary press and to transfer it to a nearby cylinder or roller of the rotary press, in a metered manner.

Furthermore, such a liquid transfer device is used to obtain a decoupling between the circumferential speeds of the two cylinders.

It is known to use a cylinder as a liquid transfer device which, when taking up the liquid from the first cylinder, for example an inking cylinder, adopts the circumferential speed of the latter. Next, the liquid transfer device is displaced as far as the nearby cylinder and rests against the surface thereof. Given that the circumferential speed of that cylinder is different from that of the first cylinder, the liquid transfer device is accelerated or slowed down. However, that acceleration or slowing down does apply dynamic stresses to the cylinder drive device and to the cylinders themselves. In order to reduce those dynamic stresses an additional cylinder, which absorbs the energy of rotation of the liquid transfer device, is provided in the form of a cylinder and slows that device down or alternatively imparts energy of rotation to the liquid transfer device and thereby accelerates it.

Thus, Published French Patent Application 2 059 689 describes an inking unit in which the ink transfer cylinder is accelerated by a belt-driven cylinder connected to a motor slaved to the linear printing speed.

Another possibility is described in Published French Patent Application 2 564 380, in which the additional cylinder is not, however, actively driven. By contrast, it serves first of all to slow down the transfer cylinder in order to bring it to a lower speed, with that cylinder accelerating by itself. Once the transfer cylinder has been additionally slowed down against the inking cylinder, it comes back into contact, on the return path, with the additional cylinder which then delivers its energy of rotation and accelerates the transfer cylinder.

However, those two aforementioned solutions do have in common the fact that the transfer cylinder effects a pendular swinging movement during which the transfer cylinder undergoes a reversal of displacement after each contact with a nearby cylinder.

That type of cycle with reversal of displacement of the transfer cylinders implies a high dynamic loading capacity of the transfer cylinder drive unit and of the support elements which support the transfer cylinder. In that case a complicated machine layout is therefore required.

Another drawback of the known solutions stems from the displacement cycles of the transfer cylinders. In effect, during the displacement cycle, intense impact energies arise and on one hand highly load the inking cylinders and the transfer cylinders and therefore increase the sensitivity of the rotary press to disturbances.

Moreover, in the two aforementioned solutions, the frequency of the pendular swinging movement of the transfer cylinder cannot be increased as much as desired when the speed of the rotary press increases. When the frequency increases, the difference between the maximum and minimum speeds of the transfer cylinder on its path between the two cylinders also increases. As a result, a corresponding amount of energy of displacement has always to be taken up and redistributed. The result thereof is heightened construction expenditure with corresponding high costs.

SUMMARY OF THE INVENTION

It is accordingly an object of the invention to provide a liquid transfer device for rotary presses, which overcomes the hereinafore-mentioned disadvantages of the heretofore-known devices of this general type, which is simple from the structural point of view and in which dynamic stresses that lead to disturbances are reduced so that an additional increase in printing speed can be obtained in comparison with traditional machines.

With the foregoing and other objects in view there is provided, in accordance with the invention, a liquid transfer device for rotary presses, comprising at least one ink fountain roller and an inking cylinder for transferring liquid, especially ink; and at least one liquid transfer element each to be displaced along a substantially circular path to come into substantially tangential contact with the at least one ink fountain roller and the inking cylinder for interacting with the at least one ink fountain roller and the inking cylinder to transfer ink from the at least one ink fountain roller to the inking cylinder.

Thus, the liquid transfer element no longer effects any pendular displacement, but instead effects an essentially circular displacement, and it is no longer necessary for any reversal of displacement of the transfer element and of its support elements to take place. As a consequence, all of the structural contrivances which were necessary in the state of the art for receiving and delivering the energy of displacement in relation to the contact surface are dispensed with.

More specifically, the cams used in the known structures for rocking the liquid transfer cylinder back and forth are dispensed with in the device according to the invention.

An additional advantage of the circular displacement of the transfer element lies in the fact that it comes into essentially tangential contact with the inking cylinder or the ink fountain roller so that the impact energy which acts on the roller or the cylinder and on the transfer element is considerably lessened.

In accordance with another feature of the invention, the transfer element, preferably a cylinder, is mounted in such a way that it can rotate freely on a rotary support. The transfer element travels a circular path under the effect of the rotary support.

In accordance with a further feature of the invention, several transfer elements of this type are disposed on the support at even angular spacings. As a consequence, the rotational speed of the support may be reduced for the same printing speed.

In accordance with an added feature of the invention, the support is driven through the use of the inking cylinder connected to the transmission system of the rotary press. At least one unit with wheels transfers the energy of displacement from the inking cylinder to the support.

In accordance with an additional feature of the invention, there is provided a braking device which correspondingly slows down the transfer element that comes past it in order to bring it to the speed of the slower cylinder and which is situated between the fast cylinder and the slow cylinder, as seen in the circumferential direction of the transfer element.

In accordance with yet another feature of the invention, there is provided an accelerating device which accelerates the transfer element coming past it in order to bring it to the speed of the fast cylinder. The accelerating device is situated on the opposite side, that is to say between the slow cylinder and the fast cylinder. As a preference, the transfer elements are mounted in such a way that a rotational movement in just one direction is possible. Rotational movements in the opposite direction can thereby be avoided.

In accordance with yet a further feature of the invention, the accelerating device is coupled to the inking cylinder for applying a circumferential speed of the inking cylinder to each of the transfer elements.

In accordance with a concomitant feature of the invention, each of the transfer elements has a freewheel device for allowing a rotational movement in one direction only.

Other features which are considered as characteristic for the invention are set forth in the appended claims.

Although the invention is illustrated and described herein as embodied in a liquid transfer device for rotary presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
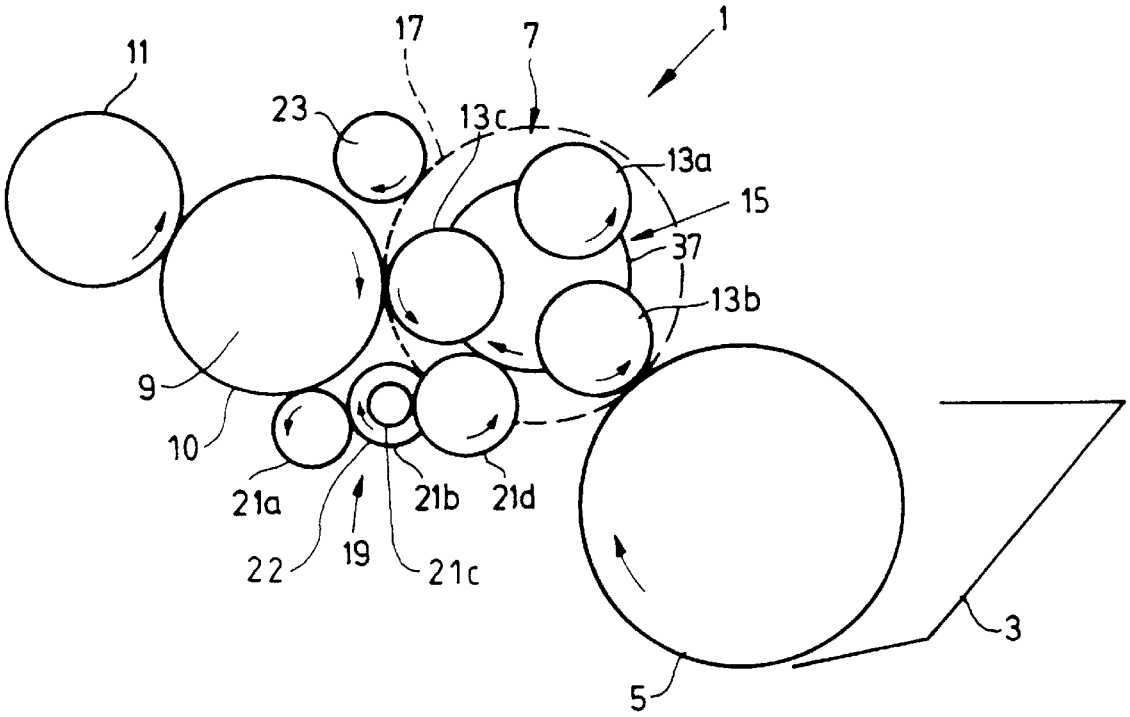
FIG. 1 is a fragmentary, diagrammatic, side-elevational view of an inking unit.

Referring now to the figures of the drawings in detail and first, particularly, to FIG. 1 thereof, there is seen a partial representation of an inking unit 1, which includes an ink fountain 3 that interacts with an ink fountain roller 5. The roller 5 rotates at a slow speed inside the ink fountain 3 that is full of ink, so that the ink wets the surface of the roller.

An ink transfer mechanism 7, the structure of which will be described in greater detail below, comes into contact with the surface of the roller 5 and picks up ink from the ink fountain roller 5.

Next, the ink transfer mechanism 7 is displaced toward another nearby cylinder, namely a first inking cylinder 9 that is connected to a transmission system of the rotary press and rotates at a speed close to it, with which it also comes into contact. This contact causes ink to be transferred from the transfer mechanism 7 to the first inking cylinder 9. Next, the ink transfer mechanism 7 returns toward the ink fountain roller 5.

The process which has just been described is repeated over again with a corresponding high frequency that is adjustable so that there is permanent transfer and therefore metering of the ink from the ink fountain 3 toward the first inking cylinder 9, through the ink fountain roller 5.

The part of the inking unit which is represented in FIG. 1 furthermore allows the inking of another inking cylinder 11 which interacts with the first inking cylinder 9 and which picks up the ink lying on the surface of the first inking cylinder 9.

Figure 2:
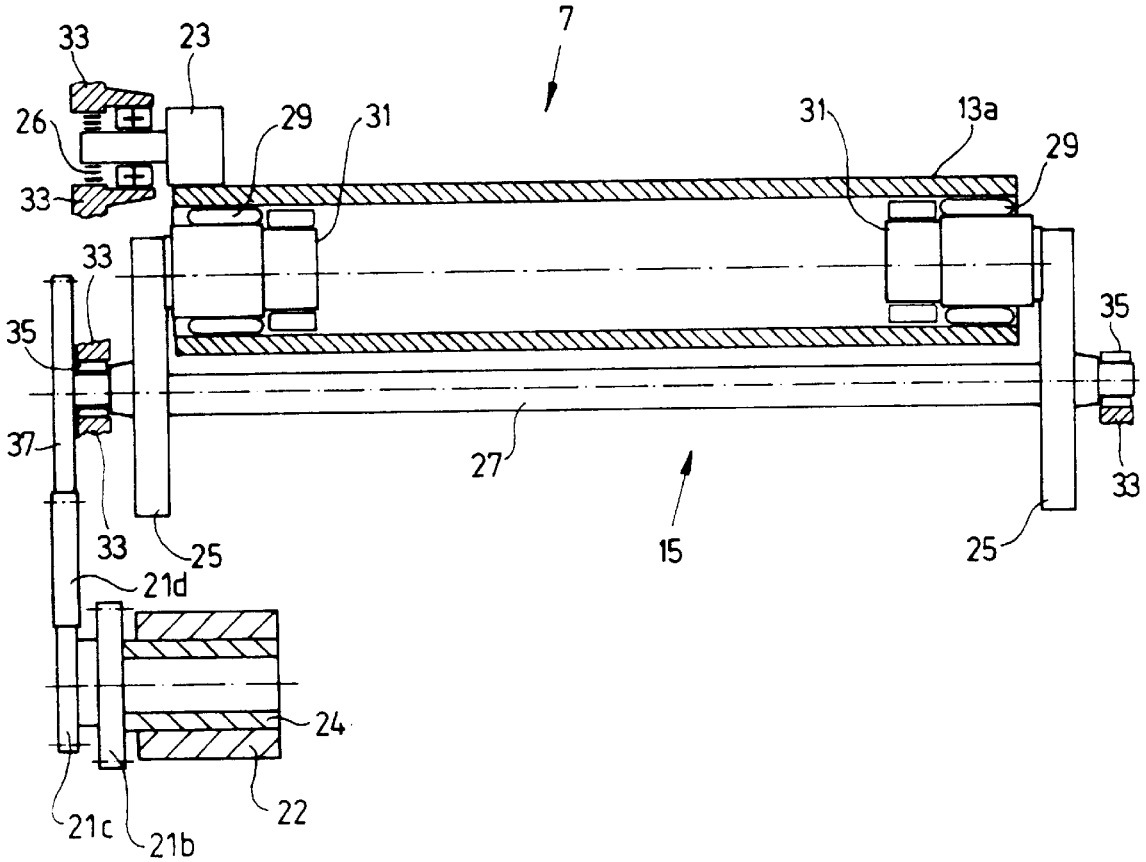
FIG. 2 is a vertical-sectional view of a transfer element.

The ink transfer mechanism 7 that is represented in this embodiment includes three ink transfer elements 13*a*, 13*b*, 13*c* which in this case are cylinders that are also known as "ink feed rollers" and which are mounted so that they can rotate on a support 15. The set of three ink transfer elements are disposed in a satellite configuration on the support 15. This support 15, which will be described in greater detail below with reference to FIG. 2, is mounted, for its part, in such a way that it can rotate about its mid-axis. The layout of this support 15 and of the ink transfer cylinders 13*a*, 13*b*, 13*c* is such that the ink transfer cylinders 13*a*, 13*b*, 13*c* come into contact both with the ink fountain roller 5 and with the first inking cylinder 9 while the support 15 is rotating.

The ink is transferred from the ink fountain roller 5 to the first inking cylinder 9 on the basis of the fact that each ink transfer cylinder 13*a*, 13*b*, 13*c* first of all comes into contact with the ink fountain roller 5. In this case, the circumferential speed of each ink transfer cylinder 13*a*, 13*b*, 13*c* is equal to the circumferential speed of the ink fountain roller 5.

The support 15 then guides each transfer cylinder 13*a*, 13*b*, 13*c* in a circular path 17, which is represented by a dotted line in FIG. 1, toward the first inking cylinder 9 that is opposite. Arrows which are clearly marked show that the direction of rotation of the ink transfer cylinders 13*a*, 13*b*, 13*c* is the opposite of the direction of rotation of the support 15.

Given that the ink transfer cylinders 13*a*, 13*b*, 13*c* are displaced in a circular path, these cylinders meet the ink fountain roller 5 and the first inking cylinder 9 tangentially.

As a result of this, the impact force which leads to disturbance and acts in the radial direction of the cylinders is greatly reduced in comparison with the configurations of the state of the art.

In the illustrated embodiment the support 15 is driven by a unit 19 with wheels which include a wheel 10 for controlling the inking cylinder 9, a set of four wheels 21*a*, 21*b*, 21*c*, 21*d* and a wheel 37 for controlling the support 15. Corresponding drive energy is delivered by the control wheel 10 of the first inking cylinder 9. The wheel 21*a* interacts with the control wheel 10. The rotational speed of the support 15 may be adjusted through a corresponding choice of diameter of the various wheels 21*a*, 21*b*, 21*c*, 21*d*.

As was already mentioned earlier, the ink fountain roller 5 and the first inking cylinder 9 rotate with different circumferential speeds. This means that when they come into contact with the ink fountain roller 5, the ink transfer cylinders 13*a*, 13*b*, 13*c* are simultaneously driven with a different speed than in the case of their contact with the first inking cylinder 9. In order for this difference in speed not to be applied to the systems for driving the two inking cylinders 9, 11 and the ink fountain roller 5, speed-compensation cylinders have been provided and are situated along the circular path 17 between the two cylinders 5 and 9.

Thus, for example, an accelerating roller 22 driven by the wheel 21*b* is located in such a way that it comes into contact with each ink transfer cylinder 13*a*, 13*b*, 13*c* in its path of displacement from the ink fountain roller 5 as far as the first inking cylinder 9. The accelerating roller 22 is connected to the wheel 21*b* through a damping ring 24 (see FIG. 2) so as to filter out disturbances arising from the acceleration of the transfer cylinders 13*a*, 13*b*, 13*c*. Through a corresponding choice of diameter of the wheel 21*b* and of the accelerating roller 22, a circumferential speed is obtained which corresponds to that of the inking cylinder 9. As a consequence, each ink transfer cylinder 13*a*, 13*b*, 13*c* which comes past this roller 22 is accelerated, bringing it to the circumferential speed of the first inking cylinder 9. The dynamic load which acts on the first inking cylinder 9 and which results from the speed compensation in the case of contact with the transfer cylinder, is therefore minimal.

The ink transfer cylinders 13*a*, 13*b*, 13*c* are slowed down in their path of displacement between the first inking cylinder 9 and the ink fountain roller 5 through the use of a braking roller 23 with which the ink transfer cylinders come into contact. This contact leads to a balancing of the rotational speed of the respective ink transfer cylinder 13*a*, 13*b*, 13*c* with respect to the ink fountain roller 5 so that, in this case too, the stress applied to the device for driving the ink fountain roller 5 is minimal.

As is shown in FIG. 2, the braking roller 23 is associated with a torsion spring 26 connected to a bed 33 so as to dissipate the energy of braking.

The configuration of the ink transfer device 7 will now be described in greater detail with reference to FIG. 2. The support 15 includes two disks 25 which are joined together through the use of a shaft 27 mounted concentrically with respect to the disks. The ink transfer cylinders 13*a*, 13*b*, 13*c* are mounted in such a way that they can rotate in an outer circumferential region of the these disks. Only the transfer cylinder 13*a* is represented but it is understood that their mid-axes extend parallel to that of the support 15. Corresponding bearings 29 are located inside each ink transfer cylinder. In addition to the bearings, freewheel devices 31 are provided to prevent the transfer cylinders 13*a* from rotating in the opposite direction.

The support 15 rests laterally against the machine bed 33 so that it can rotate through the use of bearings 35.

A drive wheel 37 which interacts with the wheel 21*d* is mounted on the shaft 27 at a longitudinal end of the support 15. In FIG. 2 it has been indicated that, as far as the drive wheel 37 and the wheel 21*d* are concerned, they are pinions which mesh with one another. The support 15 is driven in this manner, as already mentioned.

FIG. 2 furthermore shows that the braking roller 23 merely comes into contact with a lateral marginal region of the ink transfer cylinder 13*a*. The braking roller 23 absorbs some of the energy of rotation of each ink transfer cylinder 13*a*, 13*b*, 13*c* so that the latter subsequently rotate with the same circumferential speed as the ink fountain roller 5.

I claim:

1. A liquid transfer device for rotary presses, comprising:

at least one ink fountain roller;

an inking cylinder;

a driven rotary support having an axis;

a plurality of liquid transfer elements evenly distributed circumferentially around said driven rotary support, said driven rotary support displacing said plurality of liquid transfer elements along a substantially circular path, said plurality of liquid transfers elements coming into substantially tangential contact with said at least one ink fountain roller and said inking cylinder for interacting with said at least one ink fountain roller and said inking cylinder to transfer ink from said at least one ink fountain roller to said inking cylinder when said driven rotary support rotates about said axis; and speed compensating rollers accelerating and decelerating said plurality of liquid transfer elements and defining an acceleration section and an deceleration section along said substantially circular path, said acceleration section and said deceleration section occurring in said substantially circular path when said plurality of liquid transfer elements are disengaged from said fountain roller and said inking cylinder.

2. The liquid transfer device according to claim 1, wherein said plurality of transfer elements are mounted for free rotation on said driven rotary support.

3. The liquid transfer device according to claim 2, wherein said plurality of liquid transfer elements are three transfer elements evenly distributed circumferentially around said driven rotary support.

4. The liquid transfer device according to claim 2, wherein said driven rotary support is coupled to and driven by said inking cylinder and said speed compensating rollers include an accelerating roller for imparting energy of rotation to each of said plurality of liquid transfer elements and including a dampening ring for filtering out disturbances arising from accelerating said plurality of liquid transfer elements.

5. The liquid transfer device according to claim 1 wherein said speed compensating rollers include a braking roller for absorbing energy of rotation of each of said plurality of liquid transfer elements.

6. The liquid transfer device according to claim 1 wherein said speed compensating rollers include an accelerating roller for imparting energy of rotation to each of said plurality of liquid transfer elements.

7. The liquid transfer device according to claim 6, wherein said accelerating roller is coupled to said inking cylinder for applying a circumferential speed of said inking cylinder to each of said plurality of liquid transfer elements.

8. The liquid transfer device according to claim 1, wherein each of said plurality of liquid transfer elements has a freewheel device for allowing a rotational movement in one direction only.

9. The liquid transfer device according to claim 1, wherein each of said plurality of liquid transfer elements is a cylinder.

* * * * *